United States Patent [19]

Ramirez

[11] 4,341,324

[45] Jul. 27, 1982

[54] BOWL AND COVER ASSEMBLY

[75] Inventor: Richard L. Ramirez, Whittier, Calif.

[73] Assignee: Dolco Packaging Corporation, Sherman Oaks, Calif.

[21] Appl. No.: 166,884

[22] Filed: Jul. 9, 1980

[51] Int. Cl.[3] ..... B65D 41/18; B65D 43/10; B65D 21/02

[52] U.S. Cl. ..... 220/306; 150/0.5; 206/520; 220/281; 220/356; 229/43

[58] Field of Search ..... 220/306, 356, 281; 150/0.5; 206/519, 520; 229/43

[56] References Cited

U.S. PATENT DOCUMENTS

| | | | |
|---|---|---|---|
| 2,934,232 | 4/1960 | Pesch | 206/519 |
| 3,091,360 | 5/1963 | Edwards | 206/520 |
| 3,320,993 | 5/1967 | Metsenbocker | 220/306 |
| 3,718,230 | 2/1973 | James | 220/281 |
| 3,967,731 | 7/1976 | Boduch | 220/306 |
| 3,971,471 | 7/1976 | Ludder | 206/519 |
| 4,042,143 | 8/1977 | Biggins | 220/306 |
| 4,044,941 | 8/1977 | Knudsen | 220/306 |
| 4,235,349 | 11/1980 | Uhlig | 220/281 |

*Primary Examiner*—George E. Lowrance
*Attorney, Agent, or Firm*—Nilsson, Robbins, Dalgarn, Berliner, Carson & Wurst

[57] ABSTRACT

A bowl and cover assembly includes a bowl with an annular sealing lip depending radially outwardly from the upper annular rim of the bowl. The sealing lip has an annular top sealing surface and an annular edge sealing surface. The cover has a flared annular skirt about its periphery which defines a down facing mating surface and an infacing mating surface adjacent thereto. When the cover is placed over the sealing lip the top sealing surface seats against the downfacing mating surface and the edge sealing surface seats against the infacing mating surface to form an airtight seal. An annular depression in the interior surface of the bowl extends upward from an upfacing interior shoulder to provides an air bypass region to prevent vacuum locking between adjacent stacked bowls.

4 Claims, 7 Drawing Figures

FIG. 6
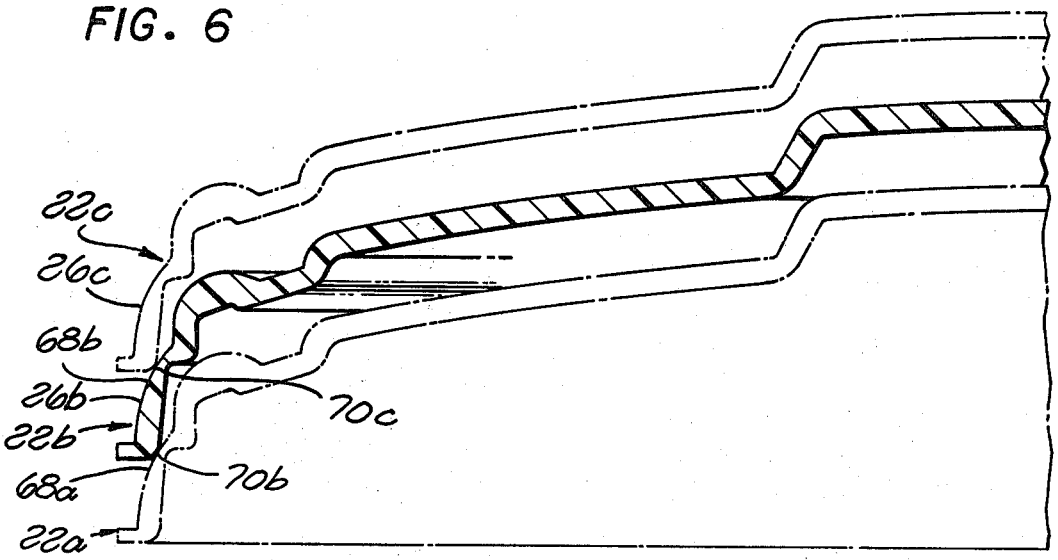
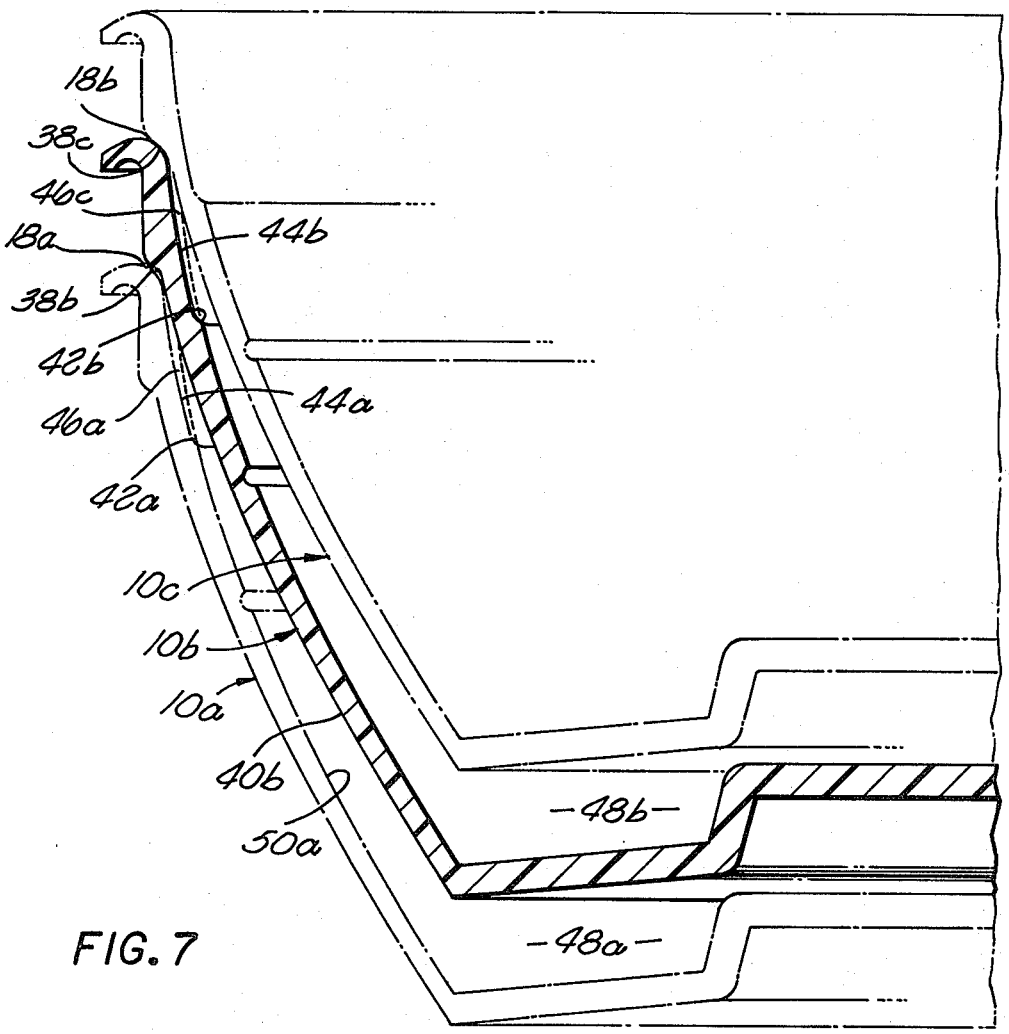
FIG. 7

BOWL AND COVER ASSEMBLY

BACKGROUND OF THE INVENTION

The present invention relates to a bowl and cover assembly and more particularly to disposable bowls and covers made from a foam plastic sheet material with both the bowls and the lids being individually stackable in a manner to prevent vacuum locking and having a configuration which provides an annular vacuum seal between the cover and the bowl.

Numerous types of bowl and cover assemblies and means for effecting a closure of the cover on the bowl have been devised. However, the present invention provides a bowl and cover which may be easily fabricated from an expanded foam plastic sheet whereby a vacuum seal is formed when the cover is placed over the bowl without the need of an inwardly directed bead or lip about the skirt of the cover. In addition, the present invention provides a configuration for both the bowl and the lid whereby a plurality of bowls may be stacked one on top of the other without the creation of a vacuum which causes vacuum locking between adjacent stacked bowls. Such vacuum locking requires that a person use both hands or otherwise be provided with an apparatus which will allow a single bowl to be separated from the remaining stack of bowls.

Likewise, the present invention provides a lid configuration whereby a plurality of lids can be stacked without creating a vacuum between adjacent stacked lids and thereby preventing vacuum locking. The elimination of vacuum locking allows the bowl and cover to be more easily and quickly handled.

Finally, the present invention fills a need in the packaging art for a lightweight disposable container for take-out food, such as Japanese or Chinese food. Heretofore, such containers for Japanese and Chinese food have generally been paper cartons which have little heat retention capabilities and exhibit various undesirable structural features. The present invention thus eliminates these problems of conventional paper containers and cartons for take-out Japanese and Chinese-type foods, and provides a container which is capable of creating a vacuum seal to retain the freshness and heat of the Japanese or Chinese food contained therein.

SUMMARY OF THE INVENTION

The present invention comprises a bowl and cover assembly formed from plastic foam material wherein the bowl includes a bottom, an upper annular rim and upwardly extending side walls rising from the margin of the bottom and terminating in the upper annular rim. An integrally formed annular sealing lip depends radially outward from the annular rim and is interconnected thereto by an annular hinge region about which the annular sealing lip is resiliently pivotal. The annular sealing lip comprises an annular top sealing surface and an annular edge sealing surface depending downwardly from the margin of the top sealing surface about the peripheral edge of the annular sealing lip.

A cover in accordance with the invention comprises a domed panel having a downwardly extending peripheral flange thereabout and an integrally formed annular skirt depending outwardly and generally downwardly from the downwardly extending peripheral flange for defining an upwardly facing outer annular skirt shoulder and an inwardly facing annular heel at the junction between the peripheral flange and the annular skirt. The annular skirt then comprises an upper laterally depending portion having a laterally disposed downfacing mating surface and a lower downwardly depending portion having an annular inwardly facing mating surface extending generally downwardly from the outer terminus of the downfacing mating surface to define an annular seal junction between the downfacing and inwardly facing mating surfaces. The downfacing mating surface is thus adapted for contacting the top sealing surface of the bowl and the edge sealing surface is adapted for contacting an annular portion of the inwardly facing mating surface for forming an airtight seal between the bowl and the cover when the annular skirt of the cover is placed over the annular sealing lip of the bowl.

In one embodiment, the annular heel is moveable radially outwardly along the top sealing surface for pressing down on the top sealing surface to break the seal between the downfacing mating surface and the top sealing surface and to simultaneously break the seal between the edge sealing surface and the inwardly facing mating surface by forcing the annular skirt outwardly. Thus, air is exhausted through the region between the heel and the annular sealing lip when the domed panel of the cover is depressed by a depression force. The seal between the annular skirt and the annular sealing lip thereafter reforms when the depression force is removed to create a partial vacuum in the covered bowl.

In yet another embodiment, the bowl may further comprise an external downwardly facing stacking shoulder having a downfacing surface and a peripheral depressed region about the upper inside surface of the bowl to define an air bypass region extending from an internal upwardly facing shoulder for providing a venting space between the outer surface of an upper stacked bowl and the inner surface of the lower stacked bowl into which the upper stacked bowl is nested.

In yet another embodiment, the annular skirt of the cover may include an annular trimming lip integrally formed with the cover which defines a radially protruding circumferential member extending from the lower edge of the lower downwardly depending portion of the annular skirt remote from the peripheral flange. The junction between the trimming lip and the lower downwardly depending portion defines an inwardly facing stacking heel. The length and shape of the annular skirt and the domed panel of the lid are then selected so that the stacking heel of the upper cover will rest on the annular skirt shoulder of the lower cover thereby preventing formation of a partial vacuum between the upper and lower covers when they are stacked on top of one another.

In order to facilitate creation and maintenance of a vacuum seal between the cover and the bowl, the domed panel of the cover may further comprise an annular spring action portion having a serpentine-like cross-section terminating in the peripheral flange for resiliently moving the stacking heel and the annular skirt of the cover radially outwardly from the center of the domed panel. The annular spring action portion also provides a structure which facilitates exhaustion of air from the covered container when the cover is depressed and maintenance of the seal between the cover and the bowl when the domed panel is not depressed.

In the preferred embodiment the annular spring action portion comprises an annular concavity and an annular convexity immediately radially adjacent to the annular concavity for defining a plurality of resilient annular spring hinge regions at the regions of annular curvature of the annular concavity and annular convexity.

BRIEF DESCRIPTION OF THE DRAWINGS

A complete understanding of the present invention and of the above and other advantages thereof may be gained from a consideration of the following description of the preferred embodiment taken in conjunction with the accompanying drawings in which:

FIG. 6 is a side, partial sectional plan view of a plurality of lids in a stacked configuration in accordance with the invention;

FIG. 7 is a side, partial sectional plan view of three bowls in a stacked configuration.

DETAILED DESCRIPTION

Figure 1:
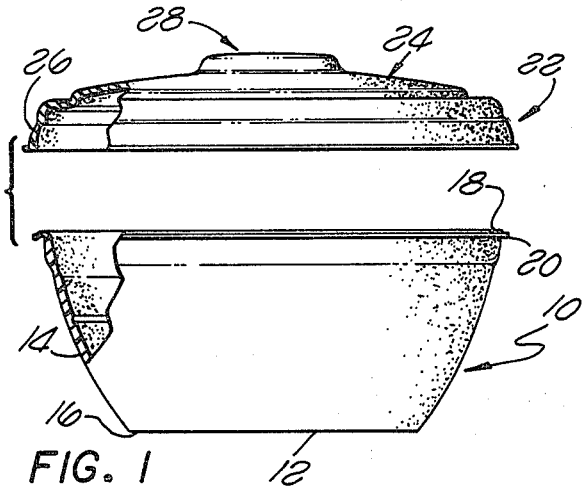
FIG. 1 is a partial cutaway plan view of a bowl and cover assembly in accordance with the invention.

Referring initially to FIG. 1, a bowl and cover assembly in accordance with the invention comprises a foam bowl 10 having an integrally formed bottom 12 and side walls 14 rising from the margins 16 of the bottom 12 and terminating in an upper annular rim 18. An integrally formed annular sealing lip 20 extends radially outward from the upper annular rim 18 of the bowl 10. The bottom 12 may be of any suitable shape and may for example have an inwardly tapered surface so that the bowl contacts a support surface only at the annular margin 16.

The side walls of the bowl 10 may comprise a plurality of interconnected side walls in the case of a square or rectangularly cross-sectioned container or other similarly shaped container with corner regions. Alternatively, the side walls may comprise a single side wall 14 having an oval or circular cross-section without corners. In a particularly suitable and preferred embodiment, the side wall 14 has a circular cross-section as shown in the figures and has an outer surface whose slope increases from the margin 16 to the upper annular rim 18. Thus, a section through the side walls 14 would define a generally parabolic or hyperbolic shape truncated at the margin 16 of the bottom.

A cover 22 is, like the bowl 10, integrally formed from foam plastic sheet material and includes a domed panel 24 with an annular skirt 26 depending downwardly therefrom, and a central protrusion 28 extending upwardly from the domed panel 24. The inside dimensions of the annular skirt 26 are selected so that the cover 22 will initially fit over the annular sealing lip 20 of the bowl 10 and thereafter as the cover 22 is pressed downwardly, the annular skirt 26 will come in contact with the edge of the annular sealing lip 20 causing the annular sealing lip 20 to deflect downwardly and the annular skirt 26 to deflect outwardly. The annular sealing lip thereupon seats in the interior surfaces of the annular skirt 26 in a manner to be discussed hereafter to form an airtight seal between the cover and the bowl.

Figure 2:
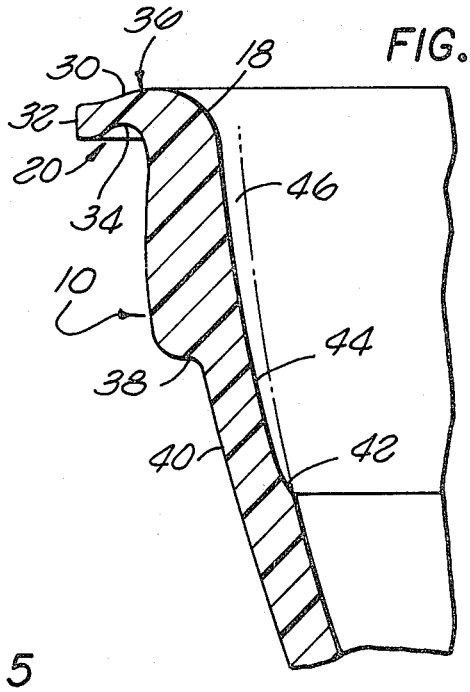
FIG. 2 is a side partial sectional plan view showing a detail of the upper portion of the bowl.

Referring now more particularly to FIG. 2, the outwardly and slightly downwardly depending annular sealing lip 20 extends outwardly from the upper annular rim 18 of the bowl 10, to define a generally upwardly facing annular top sealing surface 30 and a side facing annular edge sealing surface 32. The edge sealing surface 32 depends downwardly from the outer edge of the top sealing surface 30. The region of connection between the annular sealing lip 20 and the upper annular rim 18 may be formed somewhat thinner by integrally forming an inverted groove 34 underneath the annular sealing lip 20. This region of lesser thickness defines an annular hinge region 36 which joins the annular sealing lip 20 with the upper annular rim 18. This hinge region thus allows the annular sealing lip 20 to be resiliently deflected downwardly in response to the positioning of the annular skirt 26 of the cover 22 over the annular sealing lip 20.

The bowl 10 also comprises a down-facing peripheral stacking shoulder 38 extending outwardly from the outer surface 40 of the bowl 10 to facilitate the stacking of the bowls. The bowl further comprises an annular internal upwardly facing shoulder 42 whereby the inner surface 44 above the internal upwardly facing shoulder 42 defines an annular depression which provides an air bypass region 46 which prevents vacuum locking between adjacent bowls when the bowls are stacked on one another.

Referring more specifically to FIG. 7 in this regard, three bowls **10*a*, 10*b* and 10*c* are illustrated in a stacked configuration whereby the stacking shoulder 38*b* of bowl 10*b* rests on the upper annular rim 18*a* of bowl 10*a* and the stacking shoulder 38*c* of bowl 10*c* rests on the upper annular rim 18*b* of the bowl 10*b*. In order to prevent a vacuum from being created in the space between adjacent bowls such as the spaces 48*a* and 48*b*, it is preferred that the only contact point be between the upper annular rim of one bowl and the stacking shoulder of the adjacent upper bowl. However, when the bowls are of a shape whereby the slope of the inside surface of the bowl increases from the margin of the bottom of the bowl to the upper annular rim of the bowl (that is, the walls of the bowl tend toward the vertical), it can be seen that without a depression such as depression 44*a* in the interior surface. Of the bowl 10*a*, the inner surface 50*a* of bowl 10*a* would come in contact with the outer surface 40*b* of bowl 10*b* along a generally vertical portion of the respective walls. Because this point of contact would be between two generally vertical walls, the upper bowl can be forced into the lower bowl rather easily thereby forcing the air from the space 48*a* to create a vacuum in the space 48*a***. This vacuum creates a locking force between the two bowls which hinders their separation.

Hence, it is desired that the point of contact between adjacent stacked bowls be along a generally horizontal surface which is relatively immobile in a vertical direction to prevent creation of a vacuum between the bowls. The down-facing, generally horizontal stacking shoulders **38*b* and 38*c* are thus provided to rest on the generally horizontal upwardly facing upper annular rims 18*a* and 18*b*. In order to assure that the stacking shoulder of each upper bowl will indeed rest on the upper annular rim of the adjacent bowl, the inner outwardly depressed surfaces 44*a*, 44*b* and 44*c* are provided to provide air bypass regions 46***a* and 46*b* to assure that the inner surfaces 44*a* and 44*b* of the stacked bowls 10*a* and 10*b* will not come in contact with the outer surface 40*b* and 40*c* respectively of the bowls 10*b* and 10*c* before the stacking shoulders 38*b* and 38*c* come to rest on the upper annular rims 18*a* and 18*b* respectively.

In summary, therefore, by providing the indentation or outwardly depressed region commencing at the internal upwardly facing shoulders 42*a* and 42*b*, air bypass regions 46*a* and 46*b* are provided which prevent the creation of a vacuum between adjacent stacked bowls by assuring that the point of contact between adjacent stacked bowls will be about the generally horizontal surface junction between the stacking shoulder of the upper bowl and the generally horizontal surface of the upper annular rim of the lower bowl.

Figure 3:
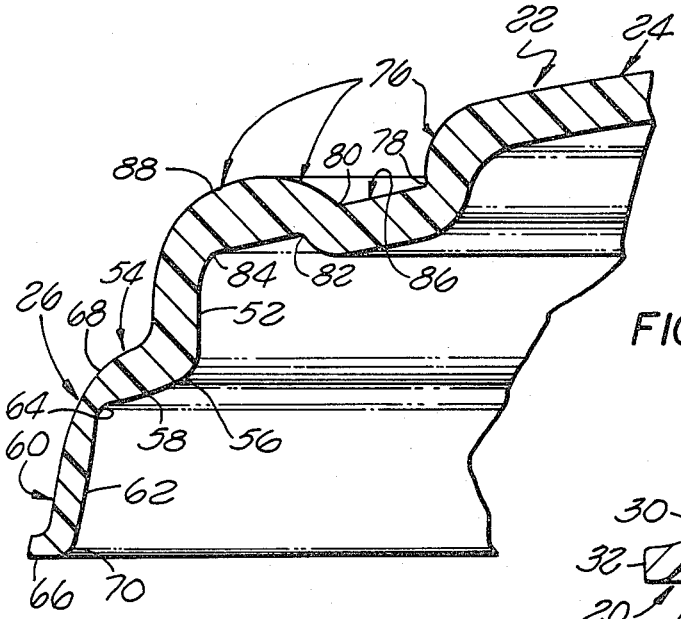
FIG. 3 is a side, partial sectional plan view showing the edge region of the cover in accordance with the invention.

Referring now more particularly to FIG. 3, the annular skirt 26 of the cover 22 extends outwardly and downwardly from a downwardly extending peripheral flange 52 of the domed panel 24. In the preferred embodiment, the annular skirt 26 includes an upper portion 54 depending generally laterally from the lower edge of the downwardly extending peripheral flange 52. The internal junction between the upper laterally depending portion 54 and the downwardly extending peripheral flange 52 defines an annular heel 56. The upper laterally depending portion 54 defines an interior down-facing mating surface 58 which extends radially outward and slightly downward from the annular heel 56.

The annular skirt 26 also comprises a lower downwardly depending portion 60 which may be slightly flared to define an annular generally frusto-conical inwardly facing mating surface 62. This inwardly facing mating surface 62 extends downwardly from an annular seal junction point 64 (at which the annular inwardly facing mating surface 62 meets the down facing mating surface 58) and terminates at an annular trimming lip 66 which defines a radially protruding circumferential lip member extending from the lower edge of the lower downwardly depending portion 60 of the annular skirt 26.

The transition between the upper laterally depending portion 54 and the lower downwardly depending portion 60 defines an outer generally upwardly facing skirt shoulder 68. In addition, the curved transition region between the lower downwardly depending portion 60 and the annular trimming lip 66 defines an inwardly directed stacking heel 70.

Referring to FIG. 6, in conjunction with FIG. 3, the length of the lower downwardly depending portion 60 is selected so that when several covers such as the covers 22*a*, 22*b* and 22*c* are stacked prior to use, the stacking heel, for example stacking heel 70*b* of the cover 22*b*, will rest on the upwardly facing skirt shoulder 68*a* of the lower cover 22*a*. Similarly, the stacking heel 70*c* of the cover 22*c* will rest on the upwardly facing skirt shoulder 68*b* of the cover 22*b*. The combination of the resiliency of the skirts 26*b* and 26*c* of the covers 22*b* and 22*c* respectively and the fact that the point of contact between the stacking heels 70*b* and 70*c* and the upwardly facing skirt shoulders 68*a* and 68*b* respectively tend more towards being in a horizontal plane rather than a vertical plane, allows a number of covers to be stacked one on top of the other without creating a vacuum between adjacent covers. This prevents vacuum locking which hinders separation of the covers when it is desired to remove a cover from the stack and place a lid on one of the bowls.

Figure 4:
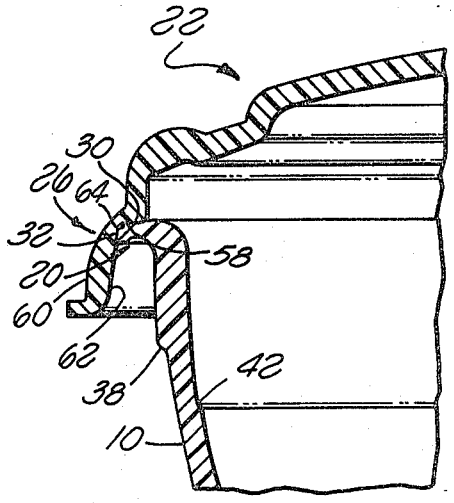
FIG. 4 is a side, partial sectional plan view of the present invention illustrating the lid in its fully seated position on the bowl.

Turning to FIG. 4, the cover 22 is illustrated in position on the bowl 10. As previously indicated, the lower downwardly depending portion 60 of the annular skirt 26 defines an annular inwardly facing mating surface 62 which is flared outwardly to define a generally frusto-conical shape surface. Thus, the internal diameter of the cover 22 at the bottommost region of the lower downwardly depending portion 60 is larger than the maximum diameter of the annular sealing lip 20. However, the internal diameter of the lower downwardly depending portion 60 of the cover 22 adjacent to the annular sealed junction 64 is slightly smaller than the maximum diameter of the annular sealing lip 20. Thus, as the cover 22 is placed over the annular sealing lip 20 of the bowl 10 the annular edge sealing surface 32 of the annular sealing lip 20 will at some point come in contact with the annular inwardly facing mating surface 62 which will cause the annular edge sealing surface 32 to resiliently deflect downwardly and inwardly so that a seal is formed between the annular edge sealing surface 32 and the annular inwardly facing mating surface 62. In addition, when the cover 22 is pressed downwardly to its full extent, the down facing mating surface 58 will come in contact with an press against the annular top sealing surface 30 to form an additional seal between the cover 22 and bowl 10 with the corner of the cover between the annular top sealing surface 30 and the annular edge sealing surface 32 being nested in the annular seal junction corner 64 of the cover 22. Thus, an airtight peripheral seal between the cover 22 and the bowl 20 will be formed.

Figure 5:
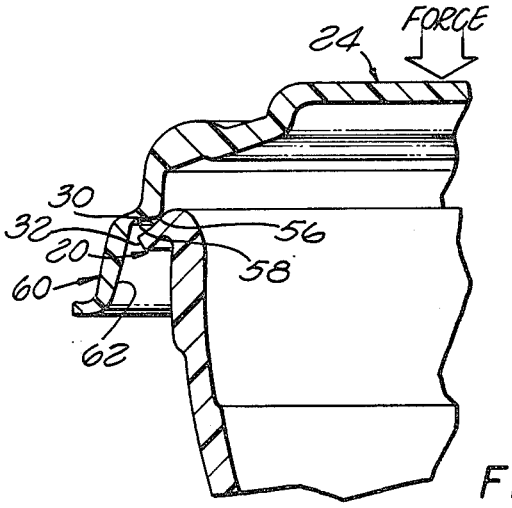
FIG. 5 is a side, partial sectional plan view of the lid and bowl when a depression force is applied to the top of the bowl.

Referring to FIG. 5, a partial vacuum may be formed in the interior of the covered bowl 10 by applying a depression force against the domed panel 24 and preferably against the protrusion 28 (FIG. 1) in the center of the domed panel 24. When such a depression force is applied, the annular heel 56 is pivoted radially outward and downward against the annular top sealing surface 30 to thereby force the annular top sealing surface 30 to separate from the down facing mating surface 58 of the cover 22. This pressing force applied by the annular heel 56 also causes the annular edge sealing surface 32 to move slightly inwardly in response to the downward movement of the annular sealing lip 20. This slight inward movement of the annular edge sealing surface 32 in conjunction with the slight outward movement of the downwardly depending portion 60 causes the seal between the annular edge surface 32 and the annular inwardly facing mating surface 62 to likewise break. Thus, the only point of sealing between the cover 22 and the bowl 10 will only occur about an annular touching point between the annular heel 56 and a point along the annular top sealing surface 30 as illustrated in FIG. 5. However, this is a very weak seal and the internal pressure of the air caused when the domed panel 24 is depressed will cause air to be forced out through that seal.

Referring to FIG. 3, in order to facilitate the radial movement of the annular skirt 26 in response to a downward depression force applied to the domed panel 24 of the cover 22, an annular spring action portion 76 is provided about the periphery of the domed panel 24. More specifically, the annular spring action portion 76 comprises an inner annular concavity 86 and an immediately adjacent outer annular convexity 88 which together exhibits a spring-like action along the plane of the domed panel 24 so that when the domed panel 24 is depressed the annular spring action portion 60 forces the annular skirt 26 outwardly as previously described. Thus, the annular concavity 86 and the annular convexity 88 combine to form a generally serpentine-like cross-sectioned member having a plurality of resilient hinge locations such as the cover locations 78, 80, 82 and 84.

Returning to FIG. 5, when the depression force is released from the domed panel 24, the annular inwardly facing mating surface 62 immediately moves inwardly and the annular edge sealing surface 32 immediately moves outwardly to reform the seal therebetween and the annular top sealing surface 30 again moves upwardly against the down facing mating surface 58 to reform the seal therebetween. A partial vacuum will thus be formed inside of the covered bowl when the depression force is released.

Although the above description has been made with reference to a particular embodiment of the invention, it will be appreciated that variations and modifications may be made in the above structure without departing from the spirit of the invention. For example, the width of the annular sealing lip 20 may vary rather substantially about the periphery of the bowl so long as the periphery of the annular sealing lip matches the shape and size of the annular inwardly facing mating surface 62 of the cover in the manner previously described.

What is claimed is:

1. A bowl and cover assembly formed from plastic foam material comprising:

a bowl comprising a bottom, an upper annular rim, upwardly extending side walls rising from the margin of the bottom and terminating in the upper annular rim, and an integrally formed annular sealing lip attached to and depending radially outwardly from the upper annular rim and joined thereto at a single annular hinge region about which the annular sealing lip is resiliently pivotal, the annular sealing lip having a single annular top sealing surface and a single annular edge sealing surface depending downwardly from the top sealing surface and defining the outermost peripheral edge of the annular sealing lip; and a cover comprising:

a domed panel having a downwardly extending peripheral flange thereabout, and an integrally formed annular skirt depending generally outwardly and downwardly from the peripheral flange for defining an upwardly facing annular skirt shoulder around the outside surface of the cover and an inwardly facing annular heel at the junction between the peripheral flange and the annular skirt, the annular skirt comprising an upper laterally depending portion having a laterally disposed down facing mating surface, and a lower downwardly depending portion having an annular inwardly facing mating surface, the down facing mating surface adapted for contacting the top sealing surface of the bowl and the edge sealing surface adapted for contacting an annular portion of the inwardly facing mating surface for forming an airtight seal between the bowl and the cover when the annular skirt of the cover is placed over the annular sealing lip of the bowl wherein said annular heel is moveable radially outwardly along the top sealing surface for pressing down on the top sealing surface to break the seal between the down-facing mating surface and the top sealing surface and to simultaneously break the seal between the edge sealing surface and the inwardly facing mating surface by forcing the annular skirt outwardly when the domed panel of the cover is depressed by a depression force, the seal between the annular skirt and the annular sealing lip reforming when the depression force is removed to create a partial vacuum in the covered bowl.

2. The bowl and cover assembly of claim 1 wherein the bowl further comprises an external downwardly facing stacking shoulder positioned for resting on the annular top sealing surface of a lower bowl stacked with the bowl, an internal upwardly facing annular shoulder positioned centrally along the side walls, and an air bypass region extending upwardly from the internal upwardly facing shoulder for providing a venting space between the outer surface of an upper stacked bowl and the air bypass region of a lower stacked bowl into which the upper stacked bowl is nested.

3. The bowl and cover assembly of claims 1 or 2 wherein the annular skirt of the cover further comprises an annular trimming lip integrally formed with the cover for defining a radially protruding circumferential member extending from the lower edge of the lower downwardly depending portion of the annular skirt remote from the peripheral flange, the junction between the trimming lip and the lower downwardly depending portion defining an inwardly facing stacking heel, the length and shape of the annular skirt and the domed panel of the cover being selected so that the stacking heel of an upper cover rests on the annular skirt shoulder of a lower cover for preventing formation of a partial vacuum between the upper and lower covers when they are so stacked on top of one another.

4. The bowl and cover assembly of claims 1 or 2 wherein the domed panel further comprises an annular spring action portion having a serpentine-like cross-section terminating in the peripheral flange for resiliently moving the stacking heel and the annular skirt radially outward from the center of the domed panel to facilitate exhaustion of air from the covered container when the domed panel is depressed downwardly.

* * * * *